US005105716A

United States Patent [19]

Hahn et al.

[11] Patent Number: 5,105,716

[45] Date of Patent: Apr. 21, 1992

[54] WEAPON THROUGHBEARING THROUGH AN ARMORED TURRET, ESPECIALLY ON A MILITARY TANK

[75] Inventors: Reinhard Hahn, Niedenstein; Uwe Sprafke, Schauenburg-Elmshagen, both of Fed. Rep. of Germany

[73] Assignee: Wegmann & Co. GmbH, Kassel, Fed. Rep. of Germany

[21] Appl. No.: 624,158

[22] Filed: Dec. 6, 1990

[30] Foreign Application Priority Data

Dec. 7, 1989 [DE] Fed. Rep. of Germany ..... 3940419

[51] Int. Cl.[5] ..... F41H 5/20; F41H 7/02

[52] U.S. Cl. ..... 89/36.13; 89/36.08

[58] Field of Search ..... 87/37.12, 37.07, 36.13, 87/36.08

[56] References Cited

U.S. PATENT DOCUMENTS

| | | | |
|---|---|---|---|
| 2,200,283 | 5/1940 | Lennon | 89/37.12 |
| 2,370,148 | 2/1945 | Colby | 89/37.12 |
| 3,340,771 | 9/1967 | DeMeiss | 89/37.12 |
| 3,348,451 | 10/1967 | Vickers | 89/37.12 |
| 3,854,377 | 12/1974 | Schiele | 89/37.12 |
| 4,358,984 | 11/1982 | Winblad | 89/36.08 |

FOREIGN PATENT DOCUMENTS

| | | | |
|---|---|---|---|
| 0125176 | 11/1984 | European Pat. Off. | 89/36.13 |

*Primary Examiner*—David H. Brown

*Attorney, Agent, or Firm*—Sprung Horn Kramer & Woods

[57] ABSTRACT

A weapon throughbearing through an armored turret, especially on a military tank, accommodating a heavy weapon that can be elevated and has a barrel mounted in a cradle and extending out through an opening in the turret that is protected by a shield. The shield consists of at least two components positioned adjacently along the axis of the weapon's barrel and in the opening in the housing, with one component secured stationary to the weapon and at least one other secured stationary to the turret.

4 Claims, 3 Drawing Sheets

WEAPON THROUGHBEARING THROUGH AN ARMORED TURRET, ESPECIALLY ON A MILITARY TANK

BACKGROUND OF THE INVENTION

The invention concerns a weapon throughbearing through an armored turret, especially on a military tank, accommodating a heavy weapon that can be elevated and has a barrel mounted in a cradle and extending out through an opening in the turret that is protected by a shield.

Weapon throughbearings of this type are generally known in conjunction with military tanks for example. The barrel extends through the shield that is secured to it. It has been demonstrated that demands on the defense of armored turrets, especially in conjunction with military tanks, are constantly becoming stricter. Increasing the defense, however, also increases the weight, which can lead to problems in the vicinity of the shield. Furthermore, increasing the weight of the shield increases the unbalances of the elevating components of the weapons system.

SUMMARY OF THE INVENTION

The object of the present invention is to improve a weapon throughbearing of the aforesaid type and decrease the additional unbalances dictated by the stricter demands on defense.

This object is attained in accordance with the invention in that the shield consists of at least two components positioned adjacently along the axis of the weapon's barrel and in the opening in the turret, with one component secured stationary to the weapon and at least one other secured stationary to the turret. Each shield component that is secured to the turret can be released from it. The barrel in one advantageous embodiment of the invention extends through a middle component of the shield that is secured stationary to the weapon with a component that is secured stationary to the turret on each side of it.

Advantageous advanced embodiments of the weapon throughbearing are specified hereinafter.

Since the weapon is inserted from outside for example (cf. e.g. U.S. Pat. No. 4,325,284) in up-to-date military tanks and since the cradle and breech extend over almost the full width of the opening in the turret, the components of the shield that are secured stationary to the turret must be released to provide access to the weapon mount when the system is assembled or disassembled. To facilitate maintenance as much as possible, it has been proven practical to design the weapon throughbearing such that the components that are secured stationary to the turret can be pivoted up around an axis and, when several components are secured stationary to the turret, to integrate them to the extent that they can all be pivoted up together. Once the shield components that are secured stationary to the turret have been pivoted up, the weapon mount will be freely accessible with no need to release the shield component that is secured stationary to the weapon. In addition to easy maintenance, there is another advantage to this approach in that the shield component that is secured stationary to the weapon can be inseparably fastened to the weapon or cradle. To make it possible to manually pivot up the shield components that are secured stationary to the turret, it can be of advantage to support it with counterweights.

One embodiment of a weapon throughbearing in accordance with the invention will now be specified with reference to the drawing, wherein

DETAILED DESCRIPTION OF THE INVENTION

Figure 1:
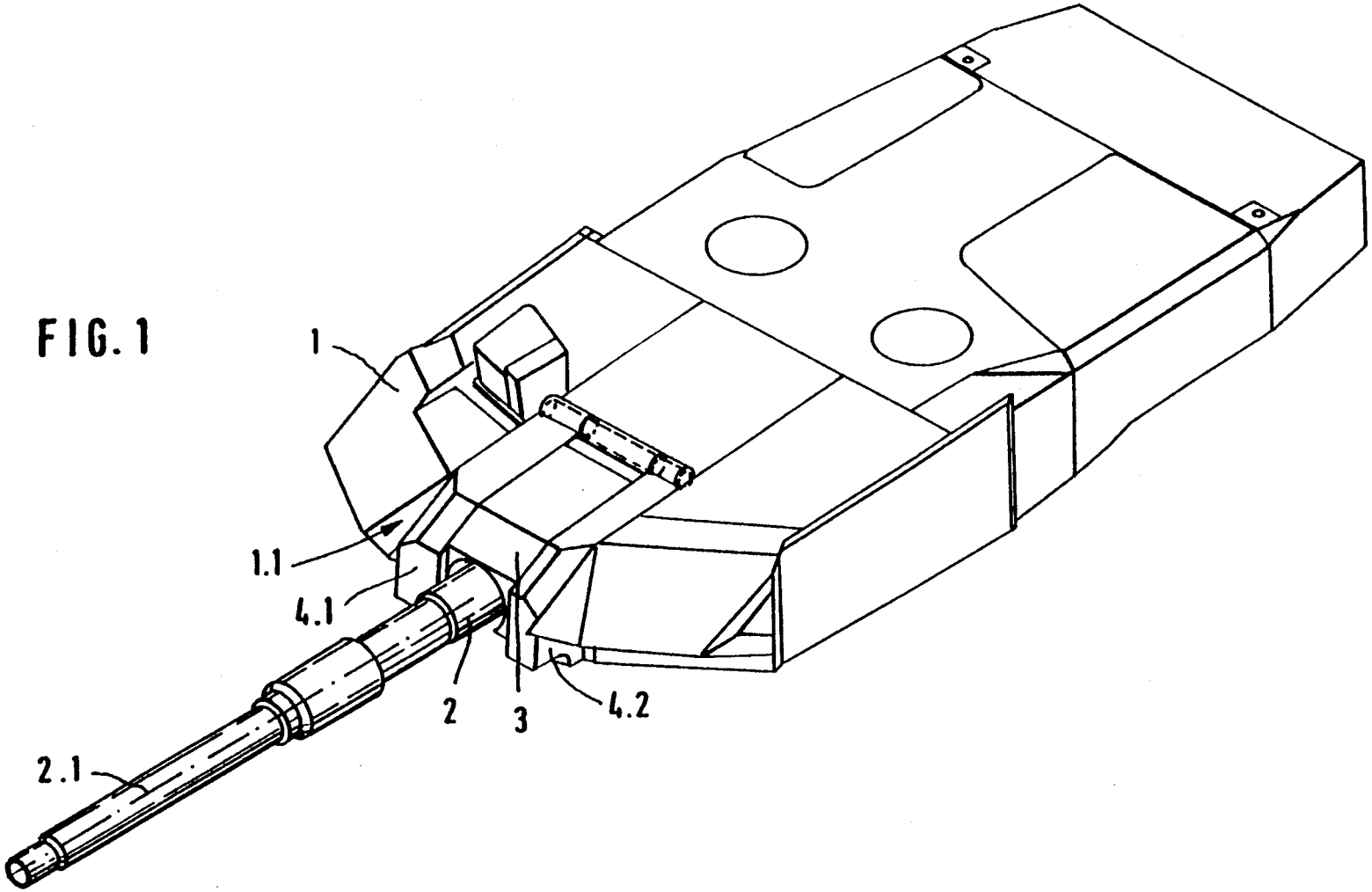
FIG. 1 is a highly schematic perspective view of a military-tank turret with a heavy weapon extending out of it.

FIG. 1 illustrates the turret 1 of an otherwise unillustrated military tank. The turret has an opening 1.1 at the front through which extends a heavy weapon 2, which can be elevated. The weapon is mounted inside opening 1.1 in an unillustrated cradle that is secured to the turret on trunnions. The opening 1.1 in turret 1 is protected by a shield that consists essentially of three components—a middle shield component 3 that is secured stationary to the weapon and two shield components 4.1 and 4.2 on each side of component 3 that are secured stationary to the turret in an unillustrated way. Components 3, 4.1, and 4.2 are accordingly adjacent at a right angle to the axis 2.1 of the weapon's barrel and completely cover opening 1.1. Distributing the shield components in this way considerably reduces the mass and hence the unbalance of pivoting component 3 in comparison with one that would itself extend over the full width.

Figure 2:
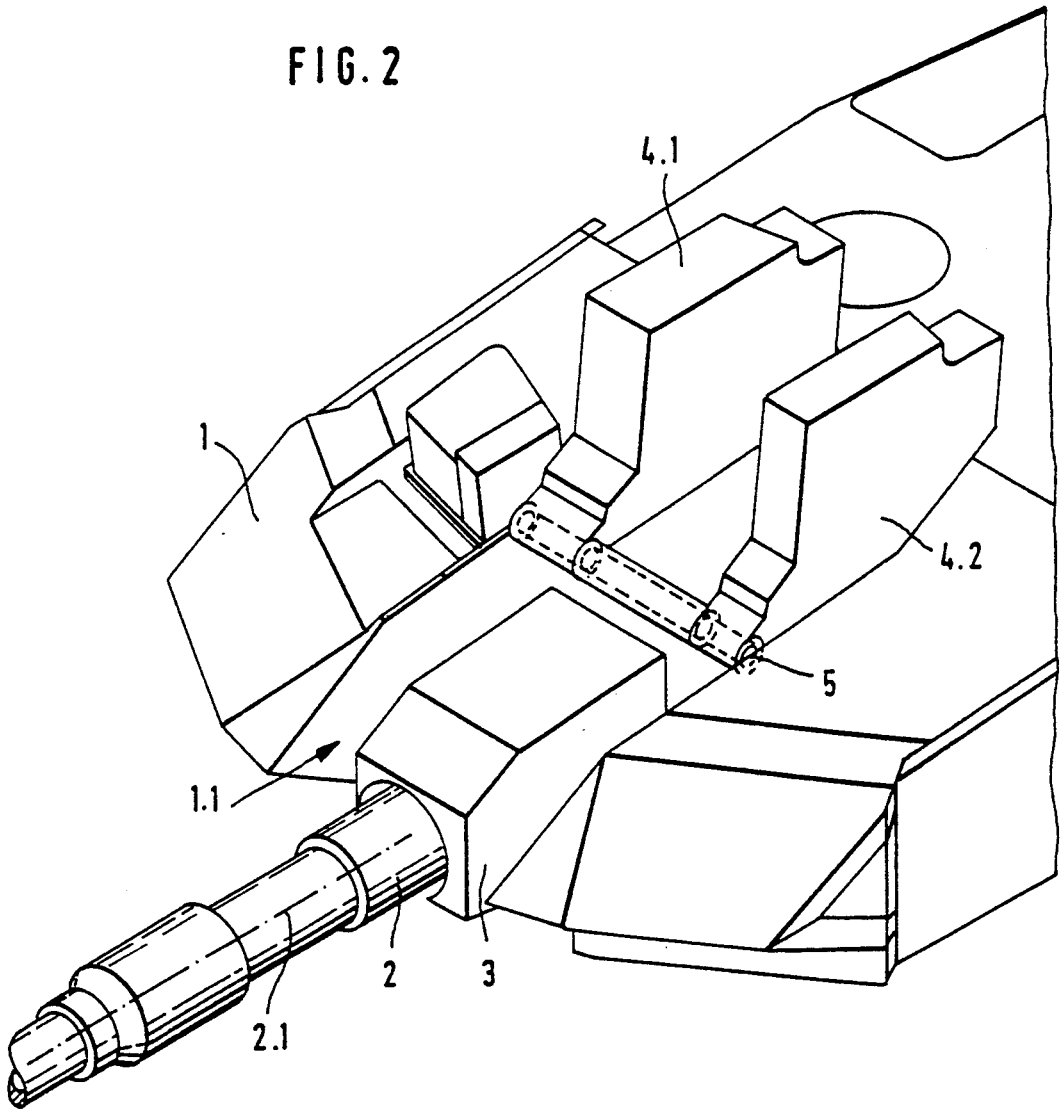
FIG. 2 is a larger-scale detail of the turret illustrated in FIG. 1 with its shield components pivoted up.
Figure 3:
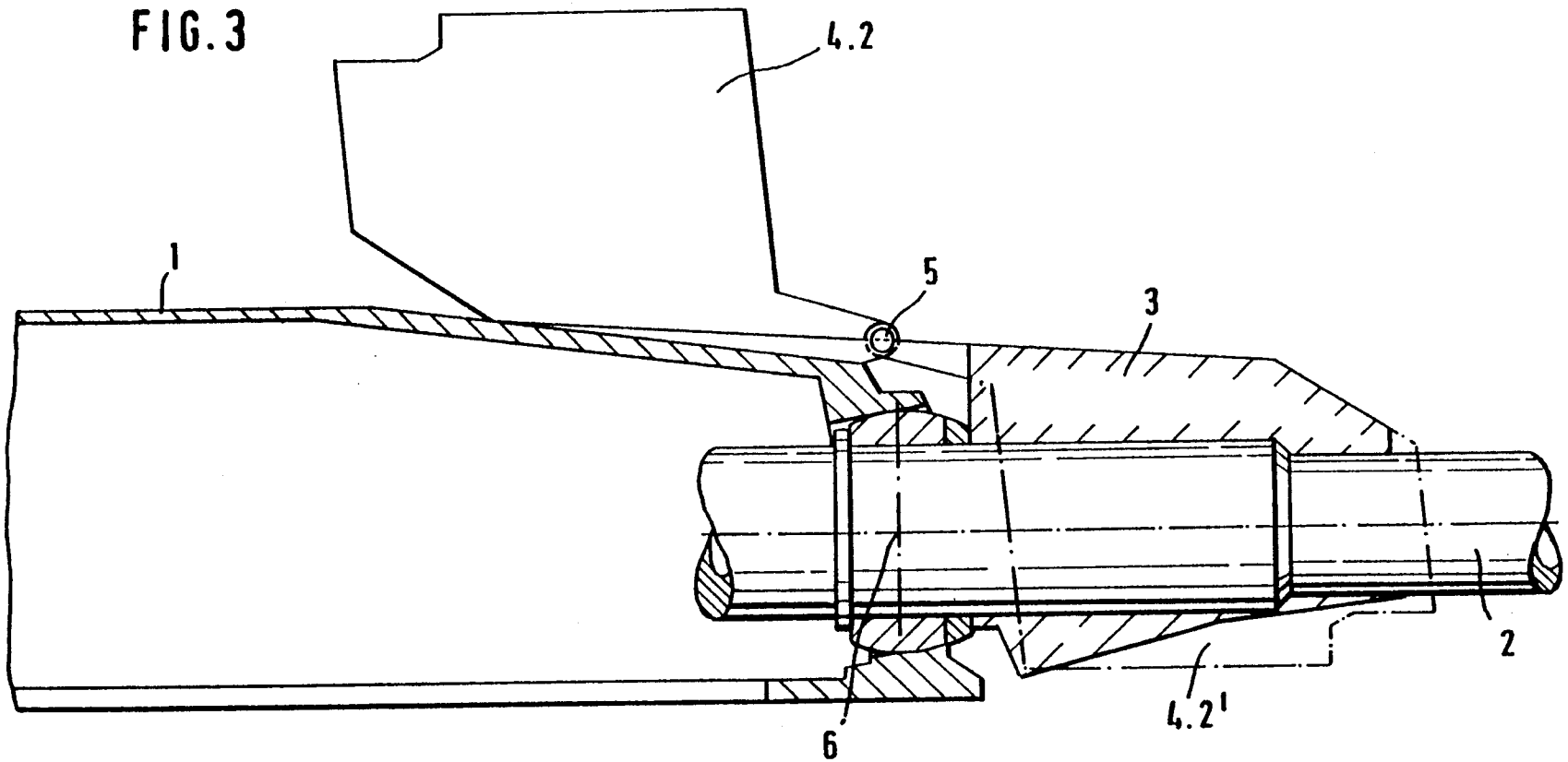
FIG. 3 is a longitudinal section through the vicinity of the trunnion axis of the turret illustrated in FIG. 2.

Since the shield components 4.1 and 4.2 that are secured stationary to the turret conceal the trunnion bearings, it is necessary to release them from their bearings and remove them when assembling and disassembling the weapon. To facilitate this procedure the shield components 4.1 and 4.2 that are secured stationary to the turret are designed as will be evident from FIGS. 2 and 3 to pivot up. The axis 5 of rotation is positioned above the axis 6 of the trunnions in the vicinity of the upper edge of opening 1.1 at a right angle to the axis 2.1 of the weapon's barrel, and the shield components 4.1 and 4.2 that are secured stationary to the turret can be pivoted up around axis 5 until they come to rest against the roof of turret 1. In this state, which is illustrated in FIGS. 2 and 3, the trunnion bearings are readily accessible in opening 1.1, and the angular-transmission component (cf. U.S. Pat. No. 4,325,284) that rests in the bearings can be adjusted without disassembling the weapon. The downward-pivoted position of the shield components 4.1 and 4.2 that are secured stationary to the turret are represented by the dot-and-dash lines (4.2') in FIG. 3.

What is claimed is:

1. A weapon throughbearing through an armored turret accommodating an elevatable heavy weapon having a barrel extending out through an opening in the turret and a shield for protecting the opening, wherein the shield comprises a first component secured stationary to the weapon and two second components secured stationary to the turret on each side of the first component with the first component in the middle and wherein the barrel extends through the first component.

2. The weapon throughbearing as in claim 1, further comprising means releasably securing each second component to the turret.

3. The weapon through bearing as in claim 1, wherein the two second components re secured stationary to the turret for pivotal movement up around an axis of rotation at a right angle to the axis of the weapon barrel.

4. The weapon throughbearing as in claim 3, wherein the axis of rotation of the two second components is in the vicinity of an upper edge of the opening in the turret.

* * * * *